US008852692B2

(12) United States Patent
Fulkerson et al.

(10) Patent No.: US 8,852,692 B2
(45) Date of Patent: Oct. 7, 2014

(54) LOW CAPACITANCE CONTAINER COATING SYSTEM AND METHOD

(71) Applicant: Nordson Corporation, Westlake, OH (US)

(72) Inventors: Terrence M. Fulkerson, Brunswick Hills, OH (US); Timothy E. Wilson, Wakeman, OH (US); Michael A. Bordner, Green Springs, OH (US); Jon Davisson, Amherst, OH (US); Brad W. Syrowski, North Ridgeville, OH (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 13/920,154

(22) Filed: Jun. 18, 2013

(65) Prior Publication Data

US 2013/0280437 A1 Oct. 24, 2013

Related U.S. Application Data

(62) Division of application No. 12/634,326, filed on Dec. 9, 2009, now Pat. No. 8,474,402.

(60) Provisional application No. 61/121,003, filed on Dec. 9, 2008.

(51) Int. Cl.
*B05D 1/04* (2006.01)
*B05B 5/08* (2006.01)

(52) U.S. Cl.
CPC . *B05B 5/08* (2013.01); *B05B 5/082* (2013.01); *B05D 1/04* (2013.01); *B05B 5/087* (2013.01)
USPC ..... 427/476; 427/481; 427/477

(58) Field of Classification Search
USPC ..... 427/476, 477, 481, 486
See application file for complete search history.

(56) References Cited

U.S. PATENT DOCUMENTS

| | | | | |
|---|---|---|---|---|
| 2,730,988 | A * | 1/1956 | Starkey | 118/635 |
| 3,945,486 | A | 3/1976 | Cooper | |
| 4,099,486 | A | 7/1978 | Bialorucki et al. | |

(Continued)

FOREIGN PATENT DOCUMENTS

| | | |
|---|---|---|
| EP | 1 806 182 | 11/2007 |
| JP | 2000-502283 | 2/2000 |

(Continued)

OTHER PUBLICATIONS

International Search Report dated Mar. 15, 2010, for International Patent Application Serial No. PCT/US2009/067331.

(Continued)

*Primary Examiner* — Frederick Parker
(74) *Attorney, Agent, or Firm* — Calfee, Halter & Griswold LLP

(57) ABSTRACT

Apparatus and method for electrostatic charging of a container for an electrostatic coating operation includes a support member for supporting a container during an electrostatic coating operation with the support member comprising a non-metallic conductive material or electrically semiconductive portion that directly contacts a surface of the container. The electrically semiconductive portion comprises non-metallic, resistive or low conductivity material and is coupled to a source of electrical energy such that the container is electrostatically charged to an opposite polarity to offset or reduce electrostatic charge build up produced by the electrostatic coating operation.

4 Claims, 10 Drawing Sheets

(56) References Cited

U.S. PATENT DOCUMENTS

| | | | | |
|---|---|---|---|---|
| 4,143,181 | A | 3/1979 | Cahn et al. | |
| 4,169,903 | A * | 10/1979 | Scholes | 427/460 |
| 4,355,764 | A | 10/1982 | Rood et al. | |
| 4,368,852 | A | 1/1983 | Sharp et al. | |
| 4,377,603 | A | 3/1983 | Itoh et al. | |
| 4,611,762 | A | 9/1986 | Turner et al. | |
| 4,640,406 | A | 2/1987 | Willison | |
| 4,887,770 | A | 12/1989 | Wacker et al. | |
| 5,346,139 | A | 9/1994 | Davis et al. | |
| 5,689,269 | A | 11/1997 | Norris | |
| 5,697,559 | A | 12/1997 | Davis et al. | |
| 5,830,274 | A | 11/1998 | Jones et al. | |
| 5,947,377 | A | 9/1999 | Hansinger et al. | |
| 6,037,012 | A | 3/2000 | Lourman | |
| 6,056,215 | A | 5/2000 | Hansinger et al. | |
| 8,474,402 | B2 | 7/2013 | Fulkerson et al. | |
| 2007/0160771 | A1 * | 7/2007 | Sarajian | 427/458 |

FOREIGN PATENT DOCUMENTS

| | | |
|---|---|---|
| JP | 2003-125694 | 5/2003 |
| JP | 2007-319734 | 12/2007 |
| WO | 97/22415 | 6/1997 |

OTHER PUBLICATIONS

Office Action dated Mar. 6, 2014, for Japanese Patent Application No. 2011-540865.

* cited by examiner

LOW CAPACITANCE CONTAINER COATING SYSTEM AND METHOD

RELATED APPLICATIONS

This application is a divisional of U.S. application Ser. No. 12/634,326 filed on Dec. 9, 2009, for LOW CAPACITANCE CONTAINER COATING SYSTEM AND METHOD, now U.S. Pat. No. 8,474,402, which claims the benefit of U.S. Provisional patent application Ser. No. 61/121,003 filed on Dec. 9, 2008, for LOW CAPACITANCE CONTAINER COATING SYSTEM, the entire disclosures of which are fully incorporated herein by reference.

TECHNICAL FIELD OF THE INVENTIONS

The present disclosure relates to coating non-conductive and low conductivity containers, such as, for example but not limited to, glass bottles, with coating material such as liquid or powder. More particularly, the disclosure relates to coating low conductivity containers using electrostatic coating processes with low capacitance devices.

BACKGROUND OF THE DISCLOSURE

Many non-conductive or low conductivity containers have one or more coating materials applied to their outer surface. These coatings may be used as a protective layer, for example. In the past, coatings have been applied using an electrostatic process. In the case of glass bottles, for example, a metal pin has been inserted into a bottle opening with a dielectric separation between the metal pin and the bottle. Metal parts in electrostatic coating systems may allow unwanted capacitive discharges, sometimes creating a safety hazard.

During electrostatic coating operations on non-conductive and low conductivity work pieces such as glass bottles, the electrostatic process may build up electrostatic charge on the bottle which may act in effect like a capacitor because the container may not effectively be grounded. This charge build up can have deleterious effects on the overall finish and transfer efficiency. Thus, low conductivity containers may become self-limiting as to how much electrostatic charge can be applied to the container during an electrostatic coating operation. The build-up of coating material on the container during a coating operation may further limit the coating process.

SUMMARY OF THE DISCLOSURE

In accordance with an embodiment of one of the inventions presented in this disclosure, an electrostatic coating apparatus for non-conductive or low conductivity containers comprises a support member that supports a container for a coating operation, with the support member including a electrostatic charge transfer portion made of a charge transfer material that is in direct or intimate contact with a surface portion of the container. One type of charge transfer material we refer to herein is a low conductivity or semiconductive charge transfer material (we also use a shorthand reference herein to "semiconductive material", it being understood that a semiconducting material as that term is used herein refers to a low conductivity or semiconductive charge transfer material). In a more specific example, the semiconductive material may be a non-metallic material, meaning a material that is substantially comprising no metal in the charge transfer material. In a general sense, we use the terms "non-metallic" and "semiconductive" with respect to the charge transfer material because the charge transfer material has an impedance to current flow or discharge, such as resistivity for example, but also allows a desired amount of charge transfer to occur between an electrical energy source and the container.

In one embodiment, the electrostatic charge transfer portion of the support member is used to apply an electrostatic charge to an outside surface of a container to offset or reduce opposite polarity electrostatic charge build up on the outside surface of the container during an electrostatic coating operation. In a more specific embodiment, the electrostatic charge transfer portion of the support member comprises an electrically resistive material that is electrically coupled to a source of electrical energy. The electrical energy applies, via the charge transfer material, an electrostatic charge to the container of opposite polarity to the electrostatic charge produced by the electrostatic coating operation. In an exemplary embodiment, the electrostatic coating operation may be carried out using a rotary atomizer that is comprised of primarily low capacitance, non-metallic components, such as shown, for example, in U.S. Pat. No. 6,056,215 the entire disclosure of which is fully incorporated herein by reference. The offsetting electrostatic charge may be applied to the container before, during, after, or any combination thereof an electrostatic coating operation. In a more specific and exemplary embodiment, the electrically semiconductive portion may comprise a carbon or graphite filled polymer, for example, a carbon filled TEFLON™ material, or a graphite filled PEEK™ material. In additional embodiments, the support member is rotatable about an axis during a coating operation.

The charge transfer material, by having an impedance to current flow or discharge, may be used not only to apply the offsetting electrostatic charge to the container, but also will prevent undesired capacitive discharges to an operator or other ground potential, during the time that the charge transfer material is coupled to the electrical energy source. In an exemplary embodiment, the charge transfer material impedance may be chosen in a range that permits offsetting charge transfer to be applied to the container, while also limiting or preventing unwanted electrostatic discharges from occurring.

By providing an offsetting electrostatic charge to the container surface, the container may be generally kept at a neutral or low residual charge potential, so that after the container is coated, the container will not capacitively hold enough charge or electrical energy to produce a discharge as the container proceeds through further finishing or processing stages. Any low residual surface charge will bleed off, such as to atmosphere, for example, so that the coated container cannot discharge to a ground potential. This benefit is attributable in part to having the support member be a low capacitance device, for example, through use of the low conductivity or semiconductive charge transfer material so that there is no capacity for holding that residual charge and allowing it to bleed off to atmosphere. Preferably, the support member contains few or no metal parts so as to minimize undesirable electrostatic charge storage capacity.

Another inventive aspect of the present disclosure is an apparatus for applying electrostatic charge to a container for a coating operation. In one embodiment, the apparatus comprises a low capacitance support for the container. In one embodiment, the low capacitance support member comprises an electrostatic charge transfer portion made of a charge transfer material that is in direct or intimate contact with a surface portion of the container. The charge transfer portion is used to apply an electrostatic charge to the container to offset or reduce electrostatic charge build up during an electrostatic coating operation. One type of charge transfer material we refer to herein is a low conductivity or semiconductive charge transfer material. In a more specific example, the semiconductive material may be a non-metal conductive material or in other words substantially comprising no metal in the material, but such is not necessarily required. In a general sense, we use the term semiconductive with respect to the charge transfer material because the charge transfer material has an impedance to current flow or discharge, such as resistivity for example, but also allows a desired amount of charge transfer to occur between an electrical energy source and the container. The semiconductive portion also serves to prevent electrostatic discharge to an operator or other ground potential, and further limits the capacitive energy stored by the support member. In one exemplary embodiment, the electrically semiconductive portion of the member comprises a low conductivity, resistive or semiconductive material that is electrically coupled to a source of electrical energy. The electrical energy applies an electrostatic charge to the container of opposite polarity to the electrostatic charge produced by the coating operation. Electrostatic charge may be applied to the container before, during, after, or any combination thereof an electrostatic coating operation. In a more specific and exemplary embodiment, the electrically semiconductive portion may comprise a carbon or graphite filled polymer material. The support may include an optional mechanism for allowing the support to be rotated during a coating operation. In another embodiment, electrical energy is coupled to the electrically semiconductive portion by creating contact between the electrically semiconductive portion and an electrically semiconductive charge transfer member.

The use of semiconductive material, and optionally non-metallic material, for the charge transfer material allows for a low capacitance coating system in that the support member need not contain any materials that would allow for sufficient electrical energy storage or store capacitive charge that could produce a discharge if in close proximity to a conductive element or ground. The charge transfer member may likewise be made of low capacitance materials so that offsetting electrostatic charge may be applied to the containers being coated within a non-conductive zone or area. In this manner, the support member and the charge transfer member, and optional rotation mechanisms for rotating the work pieces, may be low capacitance to reduce the electrical energy that can be stored in the system. By also optionally using the low capacitance electrostatic spray coating device or apparatus described above, overall capacitance of the coating system may be further reduced. This promotes safety in that the operators do not need to be shielded from electrostatic shock in the system.

The present disclosure also presents inventive methods for offsetting or reducing capacitive build up of electrostatic charge during an electrostatic coating operation of a non-conductive or low conductivity container. In one embodiment of the methods, offsetting electrostatic charge is applied to the container before, during, after, or any combination thereof an electrostatic coating operation. Electrostatic charge is applied by direct contact between a portion of the container and an electrically low conductivity or semiconductive charge transfer material that supports the container for a coating operation. In a more specific embodiment, the electrically semiconductive charge transfer material comprises a non-metallic, resistive or low conductivity material that is electrically coupled to an electrical energy source. The charge transfer material also prevents unwanted discharge from the supported container by providing a low capacitance support for the container. In a more specific embodiment, the method comprises applying an offsetting electrostatic charge to the container for an electrostatic coating operation so that the container may be generally kept at a neutral or low residual charge potential, so that after the container is coated, the container will not capacitively hold enough charge or electrical energy to produce a discharge as the container proceeds through further finishing or processing stages. Any low residual charge will bleed off, such as to atmosphere, for example, so that the coated container cannot discharge.

In another embodiment of the above method, current from the electrical energy source that is used to apply an offsetting electrostatic charge to the container during a coating operation is monitored and in response to changes in the current level, the output voltage of the electrical energy source is adjusted. In one embodiment, this adjustment may be used to prevent too much offsetting charge from being applied to the container which could otherwise cause back ionization at the surface of the container.

The present disclosure also present various embodiments of a support member that may support a container in an upright orientation, an inverted orientation or both.

These and other aspects and advantages of the inventions disclosed herein will be understood by those skilled in the art from the following detailed description of the exemplary embodiments in view of the accompanying drawings.

DESCRIPTION OF THE EXEMPLARY EMBODIMENTS

Figure 1:
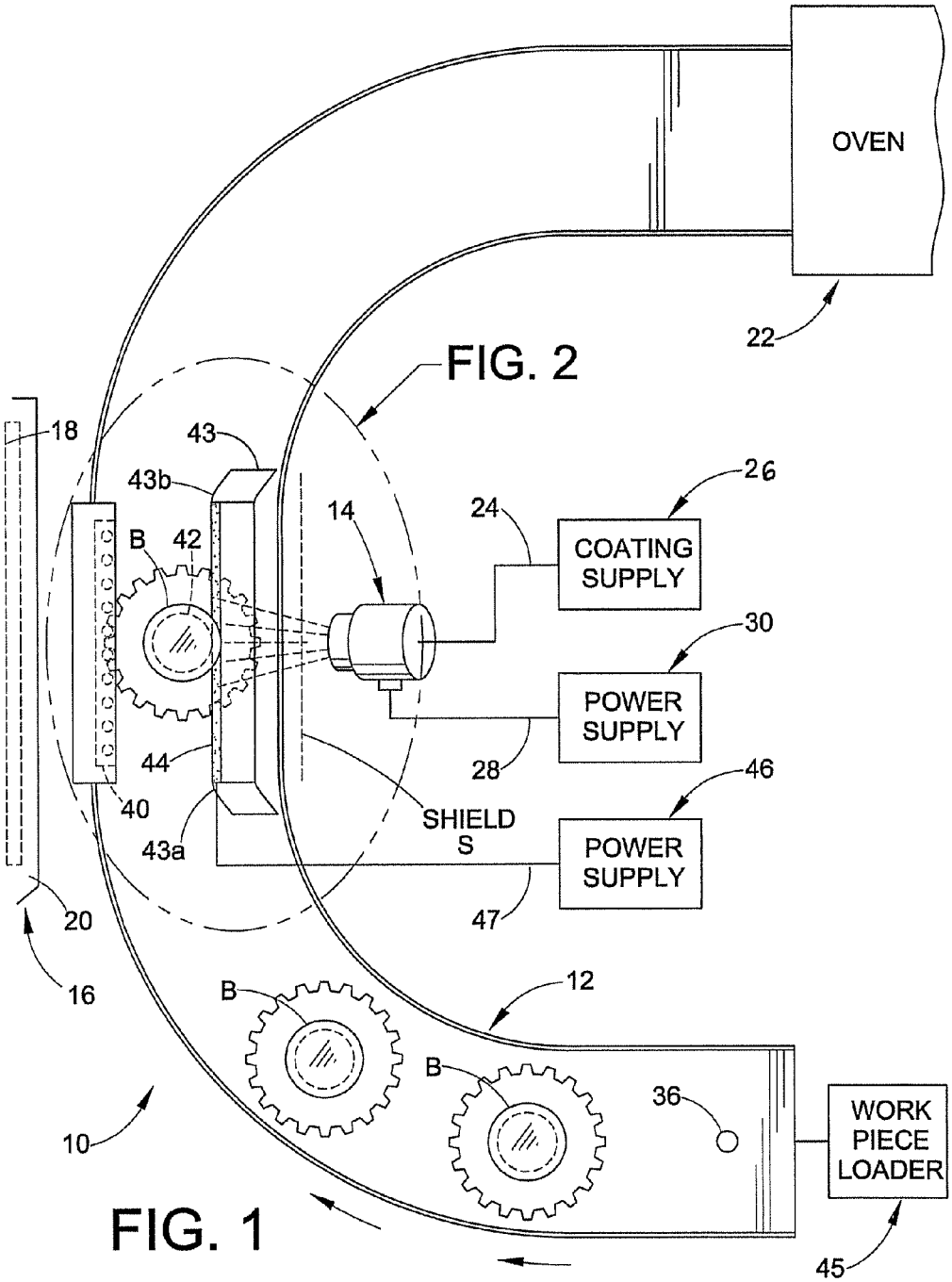
FIG. 1 is an embodiment of an electrostatic coating system for containers, in simplified schematic form and plan view.

Although the various embodiments are described herein with specific reference to liquid coating of glass containers, the inventions are not limited to such specific applications. The inventions will find application to all types of coating material used for electrostatic coating of low conductivity containers, including liquid coating material and powder coating material and so on. Moreover, the inventions are not limited to any particular type, size, shape or material of non-conductive or low conductivity work pieces. The inventions will find application to many work pieces including but not limited to glass bottle and other glass containers, plastic bottles and other plastic containers and so on. An example of one type of coating is a UV coating, but the inventions are not limited to any particular coating material.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

With reference to FIG. 1, a first embodiment of one or more of the inventions is presented. A coating system 10 may include a conveyor 12 or other suitable positioning apparatus for moving container type work pieces such as low conductivity bottles B past one or more application devices 14. The application device 14 may be disposed on one side of the conveyor 12, and a recovery system 16 may be disposed on the opposite side of the conveyor 12 across from the application device 14. The recovery system 16 may take on many different forms and functions as are well known in the art. For example, for liquid coating material the recovery system 16 may include a water wall 18 and trough 20 arrangement so that liquid material that is sprayed at a work piece but does not adhere to the work piece will be recovered. For powder coating material, powder recovery systems such as cartridge systems and spray booths are well known in the art. The particular application device 14 used will depend on many factors including the type of coating material being applied to the work piece. For a typical liquid coating application for glass bottles, the application device 14 may be an electrostatic spray device such as a low capacitance RA20 rotary atomizer available from Nordson Corporation, Westlake, Ohio. This device is an example of a type of spray device that may use primarily low capacitance non-metallic components, for example, the rotary cup. In some system 10 designs, after the conveyor 12 has transported the work pieces B past the application device 14, the conveyor transports the work pieces to further processing stations 22. For example, the conveyor may transport the work pieces to an oven 22 for drying or curing the coating material that adheres to the work piece.

As represented schematically in FIG. 1, a typical coating material application device 14 may include a supply hose 24 that connects the application device 14 to a supply 26 of coating material. An electrical cable 28 may be used to connect the application device 14 to an electrical energy source such as a high voltage power supply 30. The power supply 30 may be conventional in design as is well known in the art. The power supply 30 may provide a high dc voltage to the application device 14, or the power supply 30 may be contained within the housing of the application device 14. In the latter case, typically a low voltage is input to a voltage multiplier in the application device 14 from a suitable low voltage supply.

Figure 2:
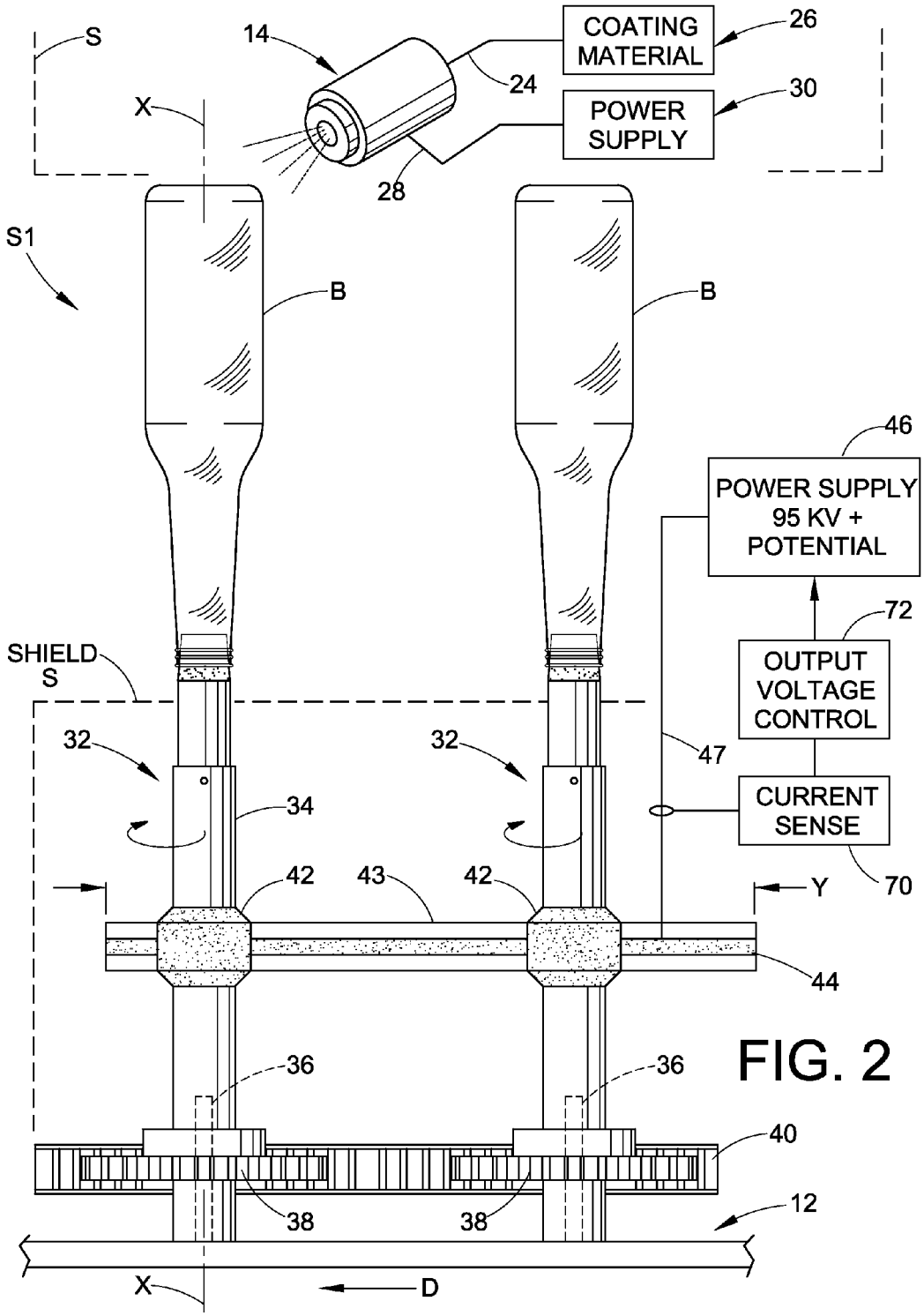
FIG. 2 is a more detailed illustration in elevation of the circled portion of FIG. 1.
Figure 3:
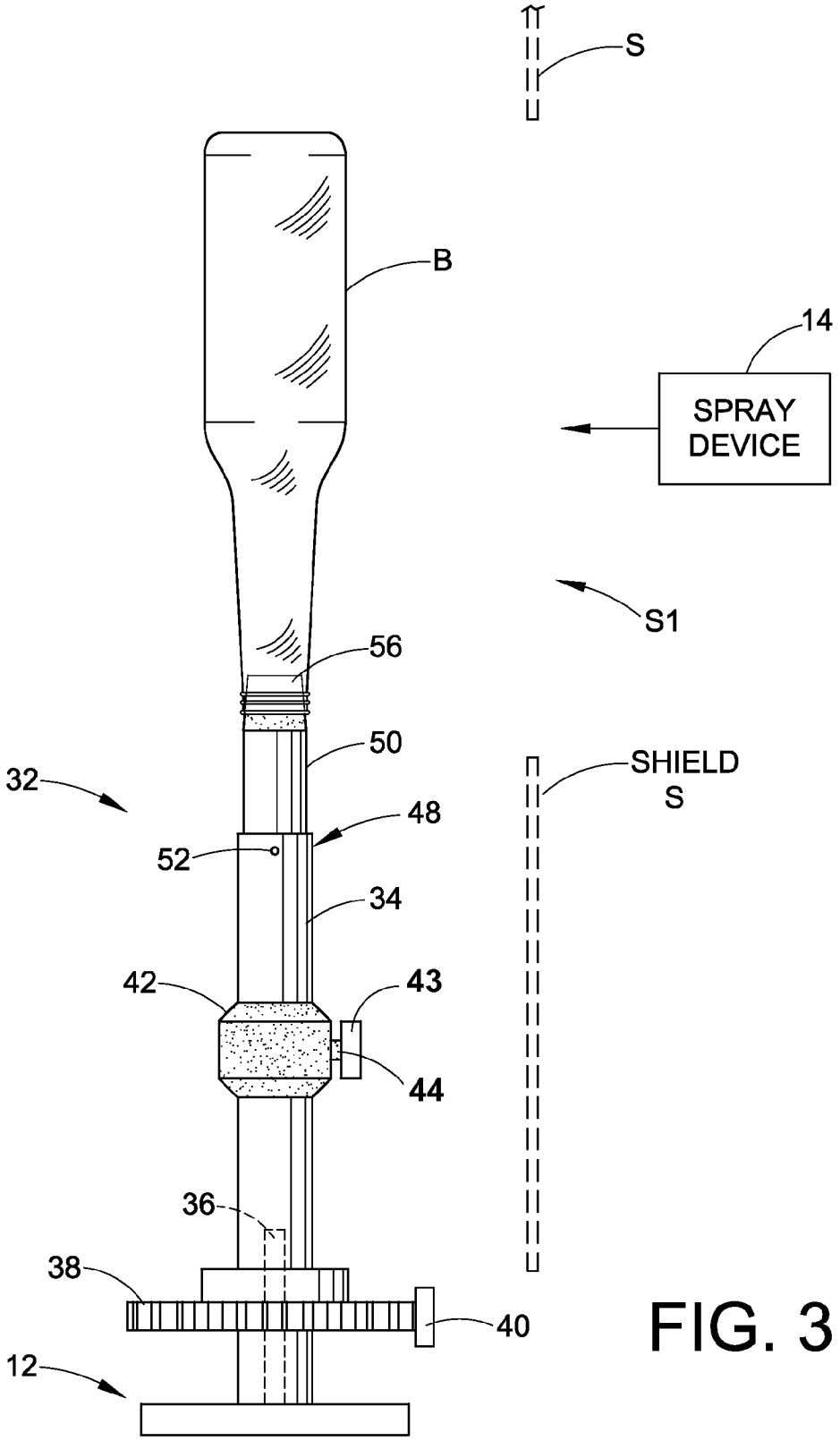
FIG. 3 is an end view of the illustration of FIG. 2.

FIGS. 2 and 3 illustrate in greater detail the structure encircled by the dashed line in FIG. 1. The conveyor 12 moves the containers B along a directional path D such as represented by the arrow D in FIG. 2, from a work piece loader arrangement 45 (FIG. 1). The work piece loader 45 may be manual or automatic. In this example, the conveyor 12 transports the containers past the application device 14 such that the application device sprays or otherwise coats the containers with coating material. Each container B in this embodiment may be a bottle that is supported in an inverted orientation on a support member 32. Alternatively, a support member may be provided that supports a bottle hanging down in an upright orientation, as further described hereinbelow. Other support arrangements and orientations may be used as needed, wherein the support structure is used to provide a low capacitance structure for applying offsetting electrostatic charge to the work piece as part of an electrostatic coating operation, as described below.

The support member 32 is mounted on and carried by the conveyor 12 by any convenient structure or method of a conveyor mounting arrangement. Conveyor systems vary widely and are well known in the art. Each support member 32 may include a hollow main body or tube 34 that slides onto a support post or spindle 36 (shown in phantom in FIG. 2) that is mounted to the conveyor 12. Thus, in this example, the spindles 36 serve as the structure of the conveyor mounting arrangement. There may be one or more spindles for each support member 32, or some other technique may be used to support the member 32 on the conveyor. The fit between the main body 34 and the spindle 36 is preferably loose enough to allow the member 32 to rotate about the axis X of the spindle. Preferably, the main body is made of a non-conductive non-metallic material.

The main body 34 may optionally include a mechanism 38 for rotating each support member 32, and with it the work piece B supported thereby. The rotation mechanism 38 may be realized, as an example, in the form of a gear-like piece that cooperates with a stationary chain 40. As the conveyor 12 moves the support member 32 in a juxtaposed position past the chain 40, the gear 38 engages the stationary chain 40 so that the member 32 rotates about an axis X. The speed of rotation of the support member 32 and hence the work piece B will be a function of the speed of the conveyor 12 as well as the gear/chain interface. In an alternative embodiment, the chain 40 may itself be moveable along the same direction D or the opposite direction from D so as to allow the work pieces to be rotated at a speed that is changeable without having to change the conveyor 12 speed. Mechanisms other than a gear and chain may be used to impart rotation of the support member 32 and work piece B as the work piece travels past the application device 14. For example, a magnetic coupling may be used, or the conveyor 12 may include a mechanism for rotating the spindle 36 and/or the support member 32. As another alternative, in lieu of a geared interface, a simple frictional wheel may be carried on the main body 34 and engage a frictional rod or pad to impart rotating motion.

As further shown in FIGS. 2 and 3, an optional shield S may be positioned between the application device 14 and the conveyor arrangement to reduce the amount of liquid material overspray that collects on the system components. For example, the shield S may comprise a non-metallic or non-conductive sheet of material such as a plastic that includes a slot or opening S1 through which the application device 14 may spray the work pieces B. A lower section of the shield S will prevent much of the coating material from being directed onto the conveyor 12 components as well as the charge transfer member 44 and the support member 32.

The support member 32 further includes a first charge transfer portion or first charge transfer element 42 comprising a charge transfer material that electrically has two useful properties. First, the charge transfer material is sufficiently electrically conductive so that electrostatic charge may be applied to the container B during a coating operation, as will be further described below. Second, the charge transfer material has an impedance to current flow, such as resistivity, that is sufficient to resist current flow and prevent unwanted electrostatic discharges should the charge transfer material be exposed to a ground or opposite polarity potential. Although in the exemplary embodiments herein the charge transfer material is the same for various portions of the apparatus, such is not necessarily required, and different materials may be used for different portions of the apparatus if so needed.

In the embodiments herein, the charge transfer material comprises a low conductivity material that is electrically resistive or semiconductive in nature. In general, we use the term semiconductive with respect to the charge transfer material because the charge transfer material has an impedance to current flow or discharge, such as resistivity for example, but also is sufficiently conductive to allow a desired amount of charge transfer to occur between an electrical energy source and the container. In the embodiments disclosed herein, the semiconductive material comprises a non-metallic conductive material, but such is not required in all applications. Therefore, a non-metallic conductive material is a preferred example of a semiconductive material that may be used with the inventions herein. The term "conductor" as used herein refers to a material that is recognized in the art as a good electrical conductor, for example, a copper wire. Conductors such as made of copper for example typically have a resistivity on the order of $10^{-8}$ ohm-meter. The term "semiconductive" as used herein does not refer to the class of materials commonly known as semiconductors, although a semiconductor material is not necessarily excluded as a type of semiconductive material herein.

An advantage of using a non-metallic or semiconductive material for the charge transfer material is that the support member 32 may be made primarily of non-metal parts so as to be a low capacitance device that cannot store sufficient electrical energy or electrostatic charge to cause an undesired discharge. Although some metal may alternatively be used in the support member 32, it is contemplated and preferred that the amount of metal used will be insufficient to allow the support member 32 to store enough capacitive charge to present a risk of an undesired discharge to an operator or to a ground potential. The use of a non-metallic or semiconductive charge transfer material also functions to resist current flow so as to prevent an undesired discharge when the charge transfer material is connected to an electrical energy source.

In this embodiment, the first charge transfer portion 42 may be realized in the form of a charge transfer ring that slides with a snug fit onto the outside of the main body 34. The main body 34 is preferably made of a non-metallic, non-conductive material such as, for example, plastic. The ring 42 is disposed on the main body 34 such that it contacts a charge transfer member 44, which may be realized in the form of an elongated bar of material supported on a frame 43. The charge transfer member 44 may be but need not be made of the same material as the ring 42. In this embodiment, the charge transfer member 44 comprises a non-metallic material. The charge transfer member 44 is electrically coupled by a conductor (such as a wire 47 for example, see FIG. 1) to a second source 46 of electrical energy. The second source 46 may be realized as a conventional power supply much like the first power supply 30.

The charge transfer member 44 may be supported by any suitable means, such as the frame 43. In order to maintain contact between the support member ring 42 and the charge transfer member 44, the charge transfer member 44 and the frame 43 may be laterally positioned so that as the conveyor 12 moves the containers B past the charge transfer member 44, the ring 42 contacts the charge transfer member 44 with an interference that may actually cause the support member 32 to be slightly off-axis (relative to the vertical axis X in FIG. 2 of the container and the support member 32). In other words, while the support member 32 is in contact with the charge transfer member 44, the support member 32 and container B are cocked a bit off-axis, so that the weight of the container in effect holds the ring 42 against the charge transfer member 44. In order to prevent the containers from rocking back and forth after the containers move past the charge transfer member, the frame 43 and charge transfer member may be provided with a lead-in and lead-out radius or taper 43*a* and 43*b*. The lead-in taper 43*a* allows the container and support member 32 to more gently assume the off-axis orientation, and the lead-out taper 43*b* allows the container and support member 32 to return gently to a vertical orientation so that the container will not rock or sway. The slight off-axis position is also optionally useful for tilting the container to a presentation angle in front of the spray device 14 to improve coating uniformity. As described hereinbelow, for the embodiments in which the containers are supported in an upright position by suspension from an overhead conveyor, as similar technique may be used to maintain contact between the charge transfer ring and the charge transfer member, with the weight of the container being used to maintain the contact. Alternatively, for containers supported in either orientation, the charge transfer member 44 and frame 43, or the support member 32, may have a bias that maintains the charge transfer member 44 in contact with the charge transfer ring 42.

The charge transfer member 44 may be made sufficiently resistive or of low conductivity material to prevent arcing from the member 44 to a nearby grounded object or discharging an electrical shock to an operator close to or in contact with the bar 44. The charge transfer member 44 also will have sufficient conductivity to allow charge transfer to the charge transfer ring 42 and the container. Therefore, the charge transfer member 44 may comprise the same charge transfer material as used for the charge transfer ring 42.

A suitable material for use as the charge transfer material of the support member ring 42 and the charge transfer member 44 is a carbon filled polymer such as TEFLON™. We have found for example that a TEFLON™ type material, or other suitable polymer, plastic or composite material, with about a twenty-five percent fill of carbon will have a suitably high resistance, but with sufficient conductivity to allow electrostatic charge transfer to the container. For higher temperature performance, we have found that a graphite filled PEEK™ material, as another example, may be used. These exemplary materials are non-metallic as preferred but not necessarily required in all applications. We have found that a suitable surface resistivity for the charge transfer material may be about 1000 ohms/square for an exemplary power supply 46 that provides about 95 kV for a charge transfer current of about 15 microamps. However, the actual surface resistivity used may be selected based on the type of power supply, the voltage level, the current and charge transfer levels, the type and size of container and material of the container and so on, to control current discharge characteristics as well as to allow sufficient offsetting charge transfer to the container. While a metal conductor typically has a surface resistivity on the order of $10^{-5}$ ohms/square, the charge transfer material used for the disclosed embodiments may have a range of about $10^{-3}$ to about $10^{6}$ ohms/square, with a more preferred range of about $10^{-1}$ ohms/square to about $10^{3}$ ohms/square for a voltage source of about 95 kV and a charge transfer current of about 15 microamps. These numbers are exemplary in nature and may be selected as needed for a particular application.

Low conductivity and optionally non-metallic conductive materials for the support member 32 and the charge transfer member 44 also allow the support member 32 and the charge transfer member 44 to be low capacitance devices to reduce the amount of electrical energy or capacitive charge that the support member 32 and charge transfer member 44 can store. This prevents an unwanted discharge to ground or shock to an operator from the support member 32 as the container and support member are conveyed through the bottle coating facility. Although in some alternative embodiments the support member 32 might contain some metal or conductors, it is contemplated that the amount of metal or conductors will be insufficient for the support member to store electrical energy or capacitive charge, and moreover that a semiconductive or non-metallic material will be included in the support member 32 to prevent current discharge. It is preferred that the charge transfer member 44 contain no metal so as to prevent shock to an operator or discharge to a ground potential.

Figure 4:
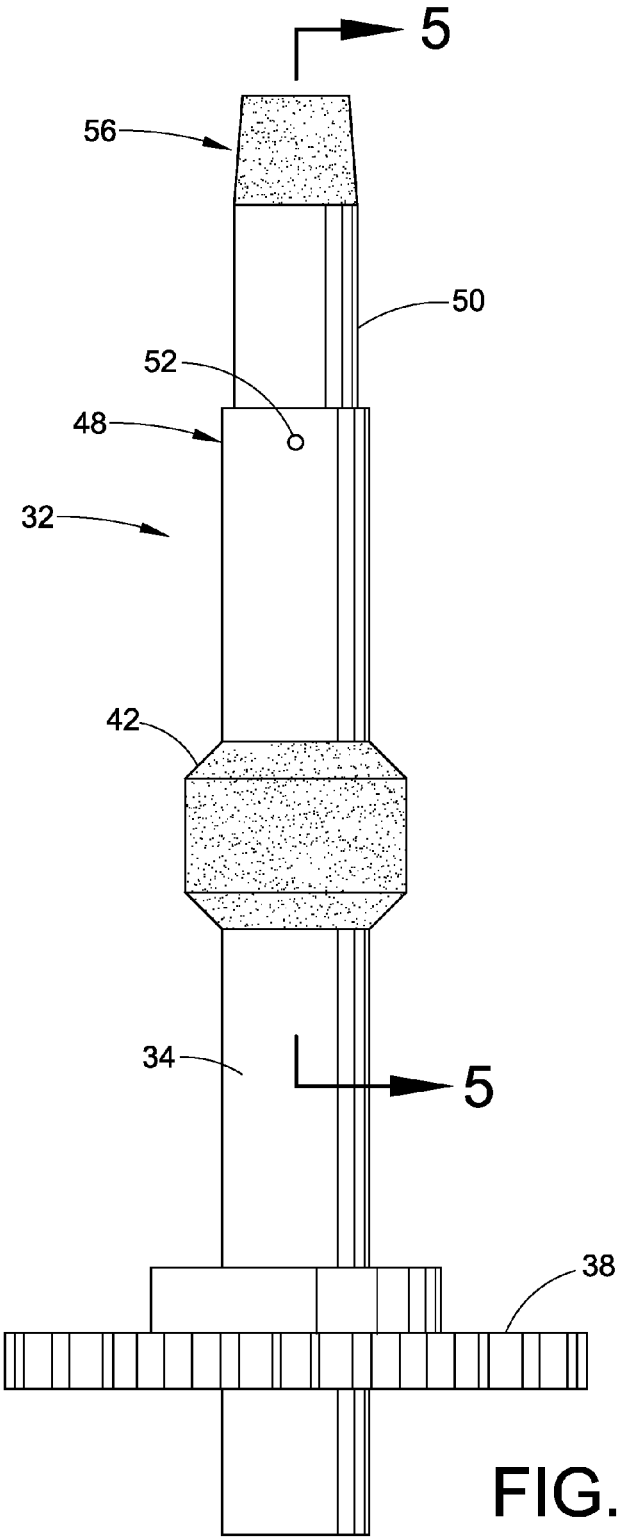
FIG. 4 is an elevation view of a work piece support member such as used in FIG. 1.
Figure 5:
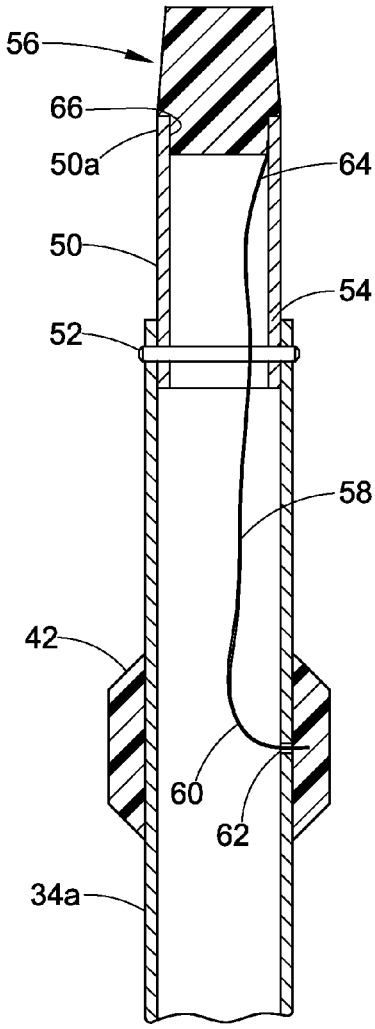
FIG. 5 is a partial longitudinal cross-section of the support member in FIG. 4.

FIGS. 4 and 5 illustrate the support member 32 in greater detail. The main body 34 may be a generally tubular structure with the gear member 38 either attached thereto by any convenient means or integral therewith. The charge transfer ring 42 may be snugly slip-fit onto the outer cylindrical surface 34*a* (FIG. 5). An upper end 48 of the main body 34 is open and telescopically receives an optional generally cylindrical work piece holder 50. The work piece holder 50 may alternatively be integrally formed with the main body 34, but by having a separate member, different sized work pieces may be used with a single design main body 34 without having to change the main body 34 each time that the work piece is changed. Thus, the work piece holder 50 when embodied as a separate element also functions as an adapter to simplify changeover between different size containers.

The work piece holder 50 may be snugly fit into the main body 34 or may more loosely fit. In the latter case, for example, the main body 34 may be provided with a catch mechanism 52 such as a simple non-metallic pin or rod for example, that extends through the main body 34 as illustrated. The work piece holder 50 may include a notch 54 at its lower end that slips over the catch mechanism 52 so that the holder 50 is supported at a proper height.

At an upper and open end 50*a* of the work piece holder 50 is a second charge transfer portion or charge transfer element 56. The second charge transfer portion 56 is preferably made of the same charge transfer material as the first charge transfer portion or ring 42, and is sized and shaped as appropriate to allow the associated work piece to be releasably mounted thereon. For example as shown, for a work piece in the shape of a conventional glass beverage bottle, the second charge transfer portion 56 may have a tapered or frusto-conical shape that inserts into the mouth of the container, much like a stopper. The selected shape and size of the member 56 will depend on the associated work piece that will be mounted thereon.

The second charge transfer portion 56 supports the work piece in such a manner as to make secure direct contact with the work piece, in this case an interior surface of the bottle opening or mouth (see FIG. 2). A close, intimate contact assures good electrical continuity between the second charge transfer portion 56 and the container, which allows for offsetting electrostatic surface charge to be applied to the container during a coating operation.

The second charge transfer portion 56 may be but need not be made of the same resistive or low conductivity material as the charge transfer ring 42 and the charge transfer bar 44 (FIG. 2). Alternatively, the first and second electrically semiconductive members 42 and 56 may be formed of a single or continuous piece of charge transfer material or made of multiple pieces as needed. The resistivity of the charge transfer material may be selected so as to allow electrostatic charge to be applied to the work piece while limiting the discharge current to prevent a spark or shock. In the embodiment herein of FIGS. 4 and 5, a wire 58 or other suitable conductor may be disposed inside the main body 34 and the work piece holder 50. The wire may be insulated, with the ends thereof removed to expose the copper wire. One end 60 of the wire 58 may be passed through a hole 62 in the wall of the main body 34. When the ring 42 is slipped into place over the hole 62, good electrical contact is made between the wire 58 and the ring 42. The opposite end 64 of the wire 58 may be captured between the inner wall surface 66 and an outer wall surface 68 of the second charge transfer portion 56. In this manner, the second charge transfer portion 56 is electrically coupled to the first charge transfer portion or ring 42. Preferably, any metal component associated with the support member 32, such as the wire 58, is disposed within the main body 34 so as prevent a discharge to a grounded potential.

With reference to FIG. 2 again, in operation, the second source of electrical energy or power supply 46 applies a voltage to the charge transfer bar 44. As the member 32 passes by the charge transfer bar 44, the first charge transfer portion or ring 42 contacts the charge transfer member 44 in a rolling fashion across the surface of the charge transfer member to provide electrical continuity from the second electrical energy source 46 to the second charge transfer portion 56 that is in contact with the work piece. With the work piece B in intimate contact with the second charge transfer portion 56, the applied high voltage from the second electrical energy source 46 transfers an electrostatic charge to the work piece B. This charge is selected to be of opposite polarity to the electrostatic charge created by operation of the application device 14 during a coating operation. For example, electrostatic spray guns often use negative voltage supplies, in which case the second electrical energy source 46 may be selected to generate positive electrostatic charge to the outside surface of the work pieces B. By appropriate control of the amount of offsetting charge on the surface of the work piece, the net surface charge on the work piece can be maintained near or at neutral or low enough to avoid what otherwise would be the deleterious effects of the electrostatic build up due to the coating operation. By having the container near neutral net surface charge, the container will not store enough capacitive charge or electrical energy to cause a discharge or shock after the support member 32 leaves contact with the charge transfer member 44. In effect, the offsetting charge functions to lower the net outer surface charge of the work piece by preventing a net surface charge build up during a coating operation.

Although there may be some residual charge left on the container after the support member 32 is no longer in contact with the charge transfer member 44, this net residual charge is low enough so as not to allow a discharge or shock, and will quickly bleed off to atmosphere because of the low capacitance of the support member 32. In order to minimize the net residual charge, the ring 42 may first contact the charge transfer member 44 before the container electrostatically sees or faces the spray device 14, and also stay in contact after the container passes by the spray device. Peak electrostatic charge occurs when the container is being coated, because this exposes the container to the highest electrostatic charge from the spray device 14.

In addition, the use of the resistive charge transfer material acts to prevent unwanted discharges or shock from the support member 32 or the charge transfer member 44 by limiting current that could otherwise occur if those components came near or in contact with ground potential.

As is illustrated in FIG. 2, the charge transfer member 44 thus may optionally be provided with sufficient length Y so as to allow the ring 42 to come into contact therewith before the work piece undergoes a coating operation—in other words before the work piece is significantly exposed to charge from the application device 14. This in effect will pre-charge the work piece B to a polarity opposite the charge effects of the coating operation, further reducing any effects from charge build up while the part is being coated. The charge transfer bar 44 optionally may also remain in contact with the support member 32 after the work piece has passed by the application device 14. Preferably although not necessarily the second electrical energy source 46 is on during an entire coating operation and the entire time that the ring 42 contacts the charge transfer member 44 in order to continue applying offsetting electrostatic charge to the container to offset charge from the coating operation in order to maintain the container near or at neutral net charge. Thus, the exemplary arrangements herein allow for the work piece to be electrostatically charged to offset the coating operation charge, either before, during, after, or any combination thereof an electrostatic coating operation.

It is known to those skilled in the art that current from the application device 14 may be monitored and controlled, such as to prevent arcing for example. In accordance with another inventive aspect of the disclosure, the current from the second electrical energy source 46 may be monitored as by a conventional current sensing or automatic feedback current (AFC) circuit 70, because this current will be related to the amount of offsetting electrostatic charge applied to the work piece. Thus the current from the second source 46 will depend on the amount of electrostatic charge being applied to the container by the spray device 14. The current level may be adjusted by adjusting the output voltage of the source 46 using a voltage adjust circuit 72 that responds to the sensed current. In this manner, the work piece may be maintained close to neutral charge during a coating operation. In an exemplary embodiment, the current may be about 10 to about 15 microamps for a voltage source of about 95 kV with a resistivity of the charge transfer material of about 1000 ohm/square. For example, as the container passes by the spray device, the surface charge due to the spray device 14 will increase substantially due to the coating process. The charge generated from the spray device is also related to the amount of electrostatic charge generated during coating operations. This charge is a function of the number and closeness of containers traveling along the conveyor as well as the voltage and current from the spray device. The current drawn from the second electrical energy source 46 will be a function of the amount of charge generated by the spray device. As the container leaves the proximity of the spray device, the surface charge due to the spray device 14 will decrease. Therefore, not as much offsetting charge will be needed other to maintain the container near neutral. The output voltage from the second source 46 can therefore be lowered so as to lower the offsetting charge level. This may be important in some applications where too much unbalanced offsetting charge at the surface of the container may cause back ionization and adversely affect the coating. In one example, the voltage from the second electrical energy source 46 may be decreased from about 95 kV to about 45 kV for a charge transfer material having a resistivity of about 1000 ohms/square, for example.

In an exemplary method for electrostatically coating a low conductivity work piece, offsetting electrostatic charge is applied to the work piece, preferably but not necessarily before the coating operation begins. The offsetting charge may be applied before, during, after, or any combination thereof an electrostatic coating operation. This charge is applied by direct intimate electrical contact between a charge transfer portion or material of a support member for the work piece, which portion is electrically coupled to an electrical energy source that applies electrostatic charge of opposite polarity to that produced by the application device 14. The charge transfer portion or material has two useful properties. First, the charge transfer material is sufficiently electrically conductive so that an offsetting electrostatic charge may be applied to the container B for a coating operation. Second, the charge transfer material has an impedance to current flow, such as resistivity, that is sufficient to resist current flow and prevent unwanted electrostatic discharges should the charge transfer material be exposed to a ground or opposite polarity potential. The charge transfer material may be a resistive or semiconductive material, and preferably non-metallic. The method may optionally include monitoring the current from the electrical energy source and adjusting an output voltage of the source to control the amount and timing of offsetting charge applied to the work piece. Preferably but not necessarily the offsetting charge is applied so as to keep the work piece electrically near or at neutral for a coating operation, and also in particular when the electrical energy source disconnects from the charge transfer portion.

From the above description, the charge transfer material therefore may be used to provide one or more important functions for the apparatus and methods herein. First, the charge transfer material allows an offsetting charge to be applied to a container when the material is coupled to an electrical energy source. Also, the charge transfer material will limit current and prevent discharge or shock even when connected to the second electrical energy source 46 due to the resistivity of the material. Still further, the charge transfer material may be used to provide a low capacitance support member for the containers, which allows residual charge to bleed off to atmosphere after the support member 32 leaves contact from the charge transfer member 44.

Figures 6, 7, 8:
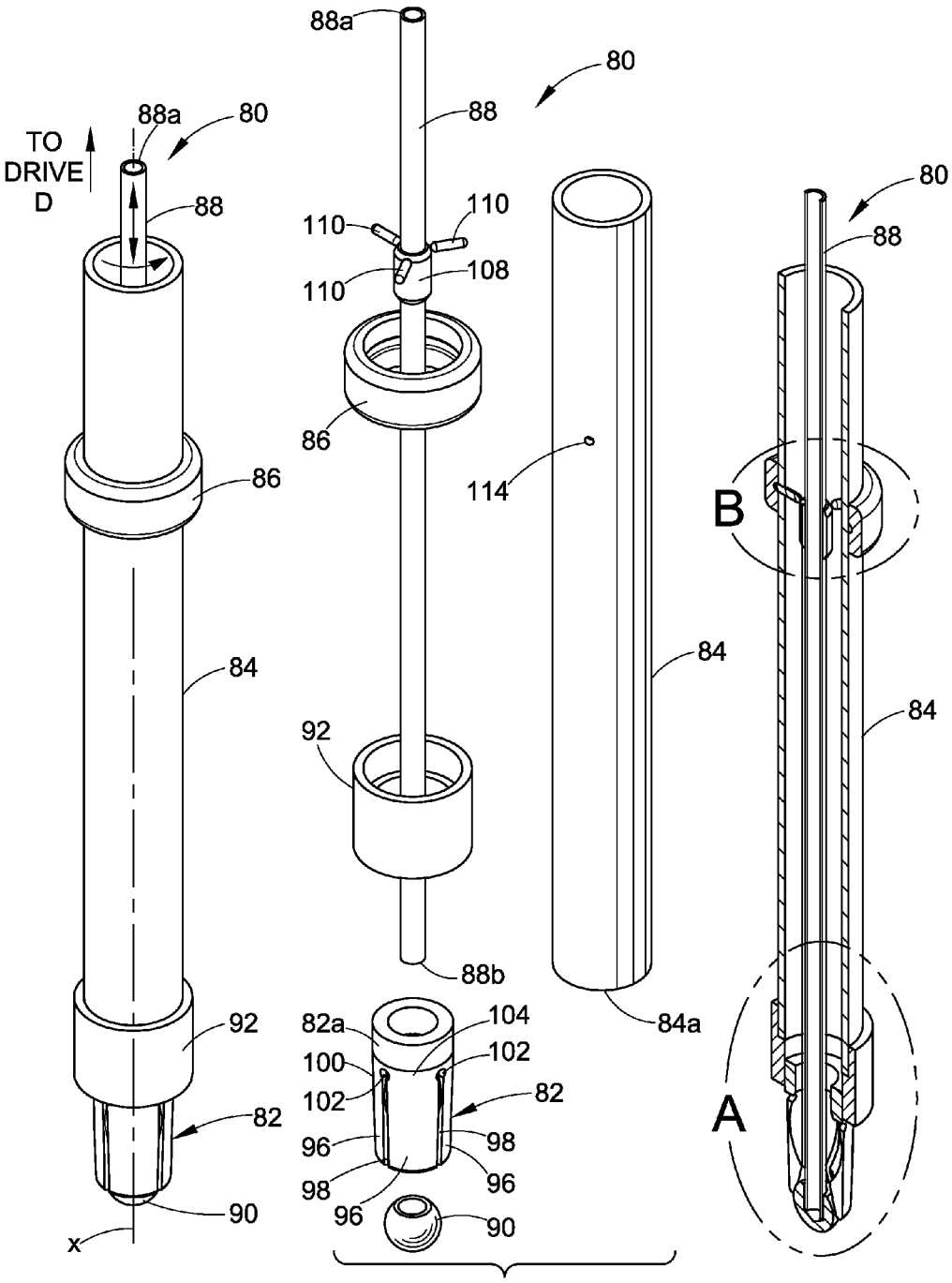
FIG. 6 is an embodiment of a support member that may be used for upright or inverted orientation of a work piece, viewed in elevation with slight perspective.
FIG. 7 is an exploded view of the support member of FIG. 6.
FIG. 8 is the support member of FIG. 6 in longitudinal cross-section.

With reference to FIGS. 6-8 we illustrate another embodiment of a support member 80 that may be used, for example, to support a work piece such as a bottle in an upright orientation. The support member 80 may also be used to support a workpiece in an inverted orientation or both, for example, if the support member is positioned by a mechanism (see FIG. 19) that can rotate the support member 80.

Figure 11:
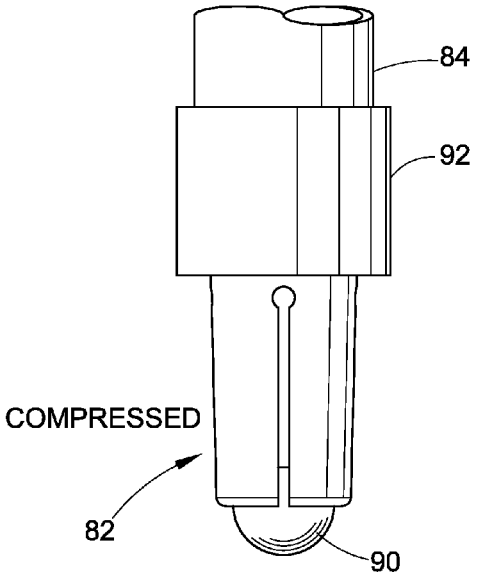
FIGS. 11 and 12 illustrate the collet embodiment of FIG. 6 in a compressed and expanded position respectively.
Figure 12:
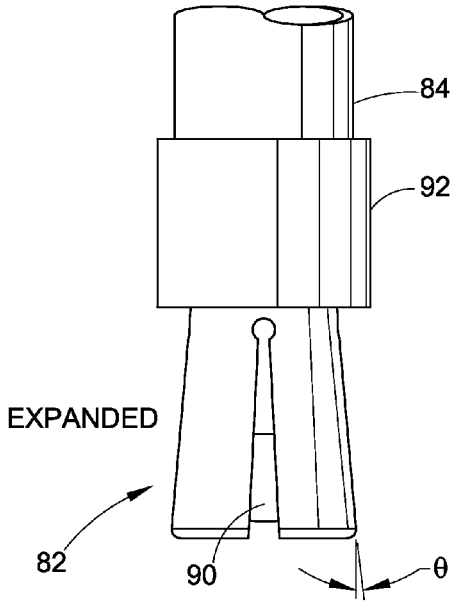
Figure 17:
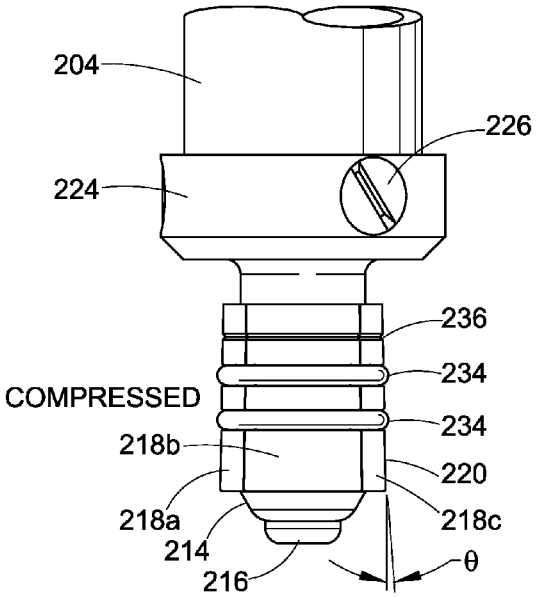
FIGS. 17 and 18 illustrate the collet embodiment of FIG. 13 in a compressed and expanded position respectively.

For supporting a work piece in an upright position, the support member 80 may be provided with a device to grip or hold a work piece, with the grip or holder in this example being realized in the form of an expandable collet 82. In a first or compressed position such as shown in FIG. 6, the collet 82 may be in its natural relaxed condition such as illustrated in FIG. 11. In such position, the collet 82 does not grip or hold the work piece. In a second or expanded position such as shown in FIG. 12, the collet may be radially expanded (radially relative to the longitudinal axis of the support member 80) so as to contact an interior portion of the work piece (not shown). For example, for a bottle, the collet 82 may engage the inner neck region of the bottle. The work piece will be supported by the bottle by providing sufficient expansion of the collet 82 to tightly engage the bottle interior portion.

The support member 80 may include an outer tube 84 that supports a voltage pick-up ring 86. The pick-up ring 86 may be but need not be similar in design to the ring 42 in the above embodiments, and therefore comprised of a resistive or semiconductive and preferably non-metallic charge transfer material, for example, graphite filled PEEK™. An actuator rod 88 extends through the outer tube and is connected at a distal end 88*b* to an expander 90 (see also FIG. 9). The expander 90 may be but need not be generally in the shape of a sphere or ball. The expander 90 may be attached to the actuator rod by a press or threaded fit, for example. The expander 90 also comprises the charge transfer material. The actuator rod free end 88*a* may be connected or coupled to a drive mechanism D that imparts linear movement to the actuator rod 88 along the longitudinal axis X. This drive mechanism D may optionally impart a rotational movement to the actuator rod about the axis X so that the work piece may be rotated during an electrostatic coating operation. The drive mechanism D imparts axial movement of the actuator rod 88 between a first or extended position and a second or retracted position.

A collar 92 is joined to a first end 84*a* the outer tube 84 and is used to hold the collet 82. In this embodiment (and also referring to FIG. 9), the collar 92 includes an internal shoulder 94 against which the first end of the outer tube 84 is seated. The collar 92 may receive the outer tube with a press fit, for example. The collar 92 may also receive a rigid neck end 82*a* of the collet 82, again with a press fit, for example.

Figure 9:
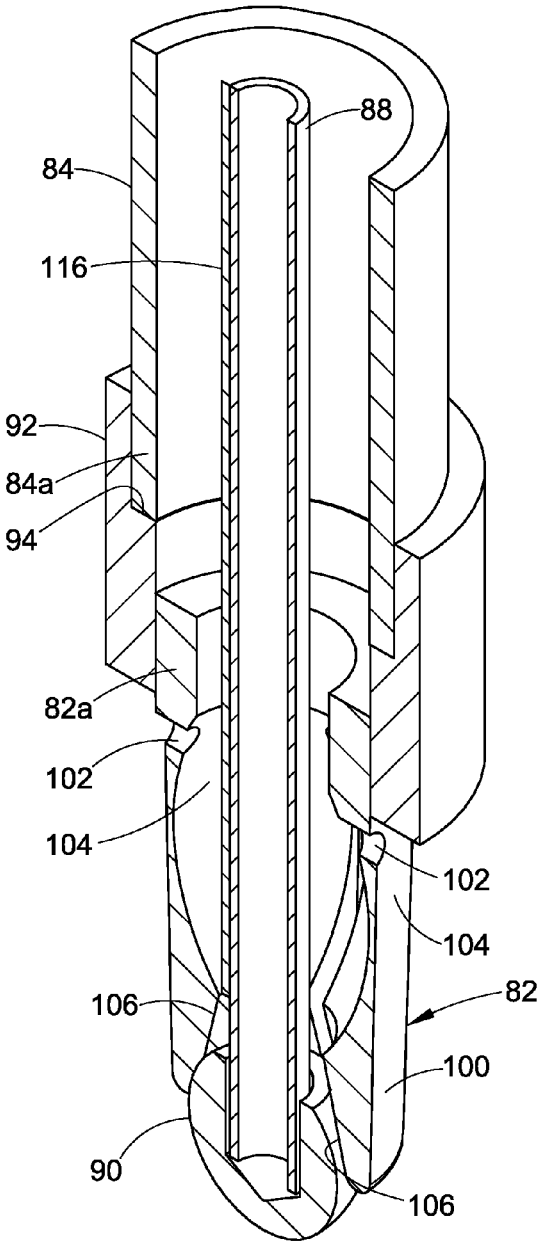
FIG. 9 is an enlarged view of the circled area A in FIG. 8.

As best illustrated in FIGS. 7 and 9, the collet 82 may be a somewhat hollow single piece member that is preferably made of the charge transfer material, and has a plurality of flexible segments 96. Thus, the collet 82 may be used to transfer electrostatic charge to a work piece when the collet 82 supports the work piece and therefore has close intimate contact therewith. The flexible segments 96 may be provided by a series of slits 98 in the wall 100 of the collet 82. Flexibility may be enhanced by also providing expansions 102 near the flexure area 104 for the flexible segments 96.

Each flexible segment 96 also may be provided with an internally tapered surface 106 (FIG. 9). These tapered surfaces 106 engage an outer surface of the expander 90 when the actuator rod 88 is moved to an axially retracted position so as to pull the expander 90 at least partially into the interior of the collet 82. When the expander 90 is pulled into the collet 82 and against the tapered surfaces 106, the flexible segments 96 will deflect outwardly so as to facilitate the collet 82 gripping an interior surface of the work piece. This is the condition illustrated in FIG. 12. The outward deflection of the flexible segments 96 may be used to produce a reverse taper angle θ (referenced herein to the longitudinal axis X) that can facilitate the ability of the collet 82 to grip the work piece, as some work pieces may have internal tapers and shapes other than cylindrical. When the actuator rod 88 is in its axially extended position, the expander 90 may simply contact the tapered surfaces 106 or moved far enough axially so as to not contact the tapered surfaces, but in either case will allow the collet 82 to compress sufficiently to allow the work piece to no longer be held by the collet 82.

Figure 10:
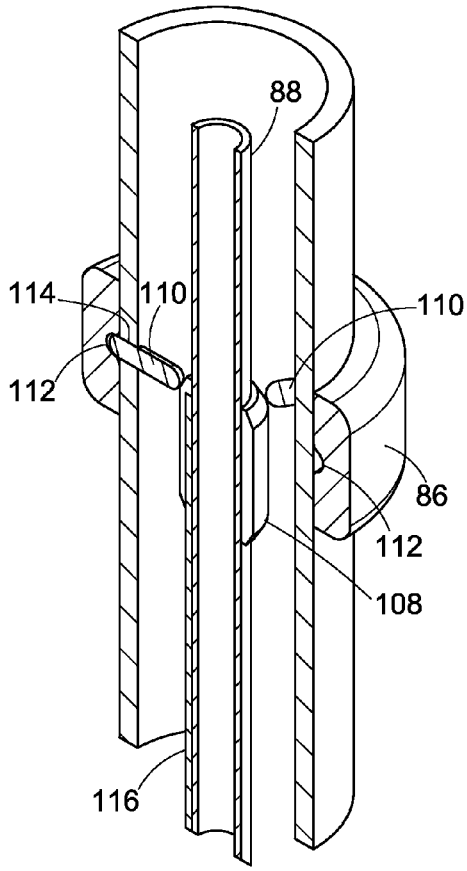
FIG. 10 is an enlarged view of the circled area B in FIG. 8.

With reference also to FIG. 10, the pick-up ring 86 is preferably snugly retained on the outer tube 84. A charge transfer collar 108 is provided on the actuator rod approximately axially aligned with the pick-up ring 86. The charge transfer collar 108 also comprises the charge transfer material. A series of spring loaded contacts 110 are disposed between the outer surface of the charge transfer collar 108 and an internal surface of the pick-up ring 86. For example, each contact 110 may have an outer end captured in a groove 112 formed in the pick-up ring 86 interior, and an inner or opposite end that contacts the outer surface of the charge transfer collar 108. The contacts 110 may extend through respective holes 114 formed in the outer tube 84. The contacts may be conductors such as metal or may be semiconductive material. Preferably the contacts 110 are spring loaded or otherwise biased into contact with the charge transfer collar 108 so as to maintain contact therewith even during movement of the actuator rod 88 and the charge transfer collar 108. The axial dimension and position of the charge transfer collar preferably may be chosen such that when the actuator rod 88 is moved to its axially retracted position (that corresponds to the expanded state of the collet 82), the contacts 110 are assured to maintain electrically continuity with the charge transfer collar 108. Moreover, when the actuator rod 88 is extended axially so as to move the expander 90 away from a position of forcing the flexible segments 100 apart (thus corresponding to the compressed state of the collet 82), preferably the contacts 110 will no longer have electrical continuity with the charge transfer collar 108. This latter condition thereby isolates any electrical voltage from the expander 90 and the collet 82 when the collet is not holding a work piece.

As best illustrated in FIGS. 9 and 10, a charge transfer sleeve 116 may be used to electrically couple the charge transfer collar 108 with the expander 90 when the actuator rod 88 is in the retracted position. The charge transfer sleeve 116 extends axially along the actuator rod 88 to a distal end 116*a* such that when the actuator rod 88 is in the refracted position, the charge transfer sleeve 116 contacts the expander 90. In this position the expander 90 is also in intimate contact with the flexible segments 100 so that electrical energy, and more notably electrostatic charge, may be transferred to the work piece for a coating operation. When the actuator rod 88 is in the extended axial position, the charge transfer sleeve 116 loses contact with the expander 90 so as to isolate electrical energy from the expander 90 and the collet 82. It will also be noted that when the actuator rod 88 is in the retracted position such that electrical energy is being supplied to the expander 90 and the collet 82, the charge transfer sleeve 116 is fully disposed within the outer tube 84 to help isolate charge and current from the surrounding environment. Preferably, the outer tube may be made of a non-conductive material such as plastic to facilitate this isolation.

As in the above embodiments, the pick-up ring 86 contacts a charge transfer member so as to receive electrical energy from an electrical power source. The electrical energy, and more notably electrostatic charge, is therefore transferred to the work piece through the support member 80 and intimate contact between the collet 82 and the work piece.

In an alternative embodiment, the actuator rod 88 may be made of two sections, with the lower section comprising the charge transfer material and an upper section being electrically non-conductive. The charge transfer collar 108 could then make direct contact with the actuator rod, so as to remove the use of the charge transfer sleeve.

It will further be noted that by simply removing the expander 90 from the actuator rod 88, the collet may be pulled out of the collar 92 for replacement or for a size change in the event that different size collars are needed for different size containers.

Figure 13:
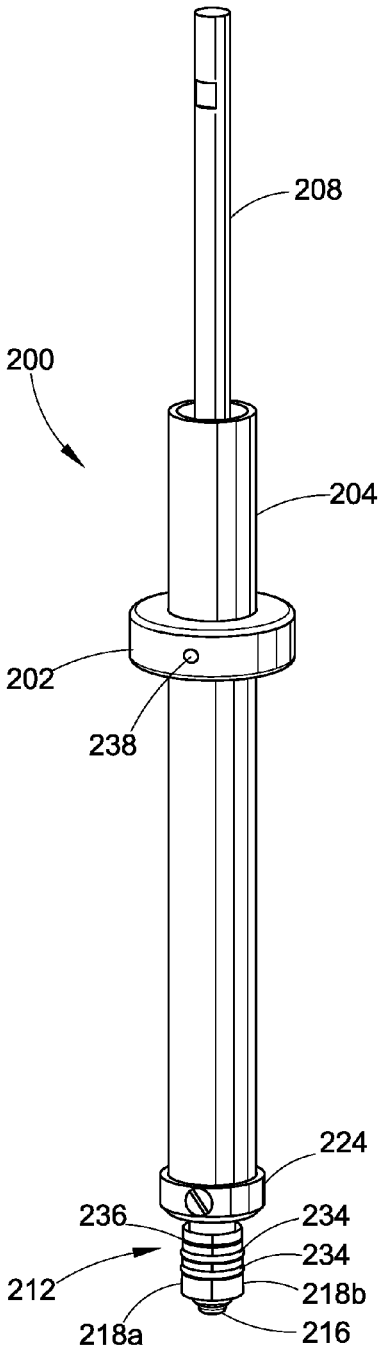
FIG. 13 is another embodiment of a support member that may be used for upright or inverted orientation of a work piece in elevation with slight perspective.
Figure 14:
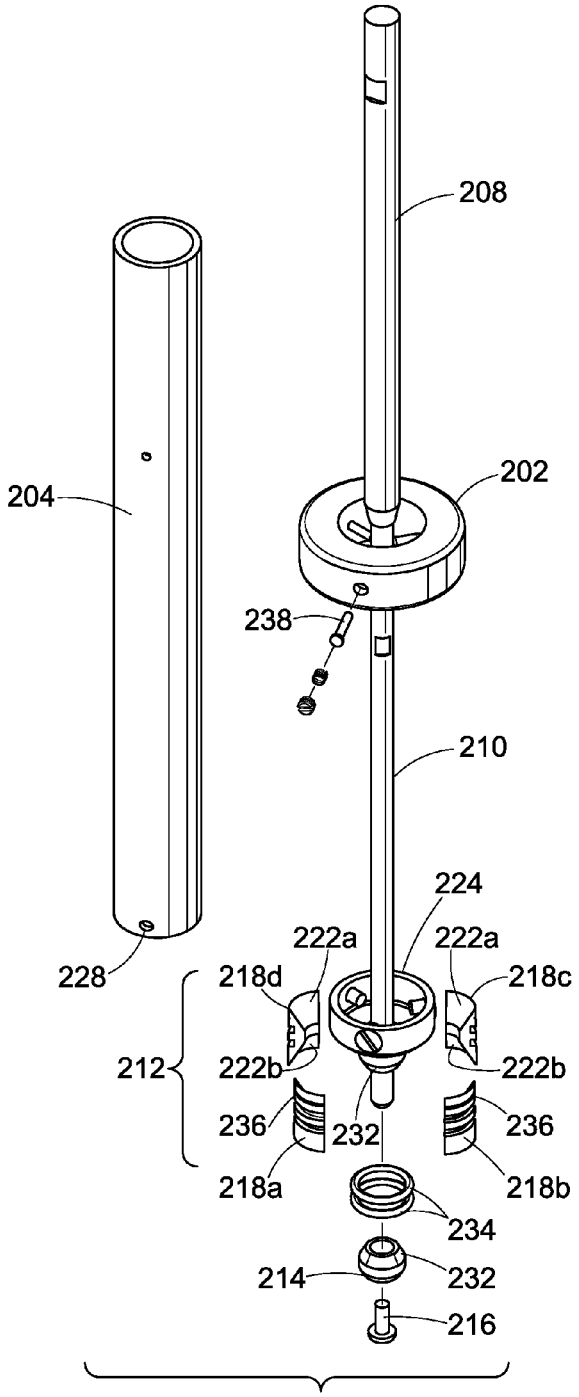
FIG. 14 is an exploded view of the support member of FIG. 13.
Figure 15:
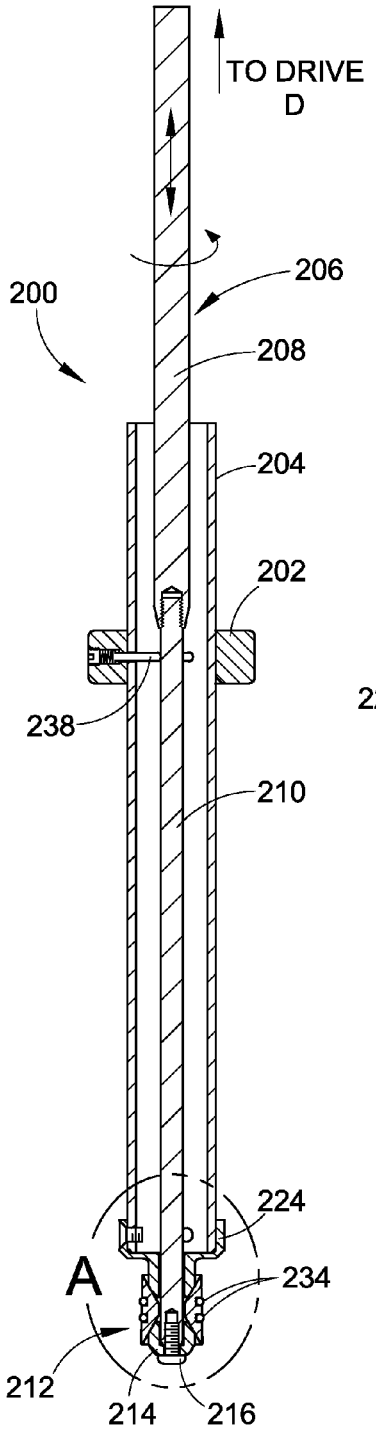
FIG. 15 is the support member of FIG. 13 in longitudinal cross-section.
Figure 16:
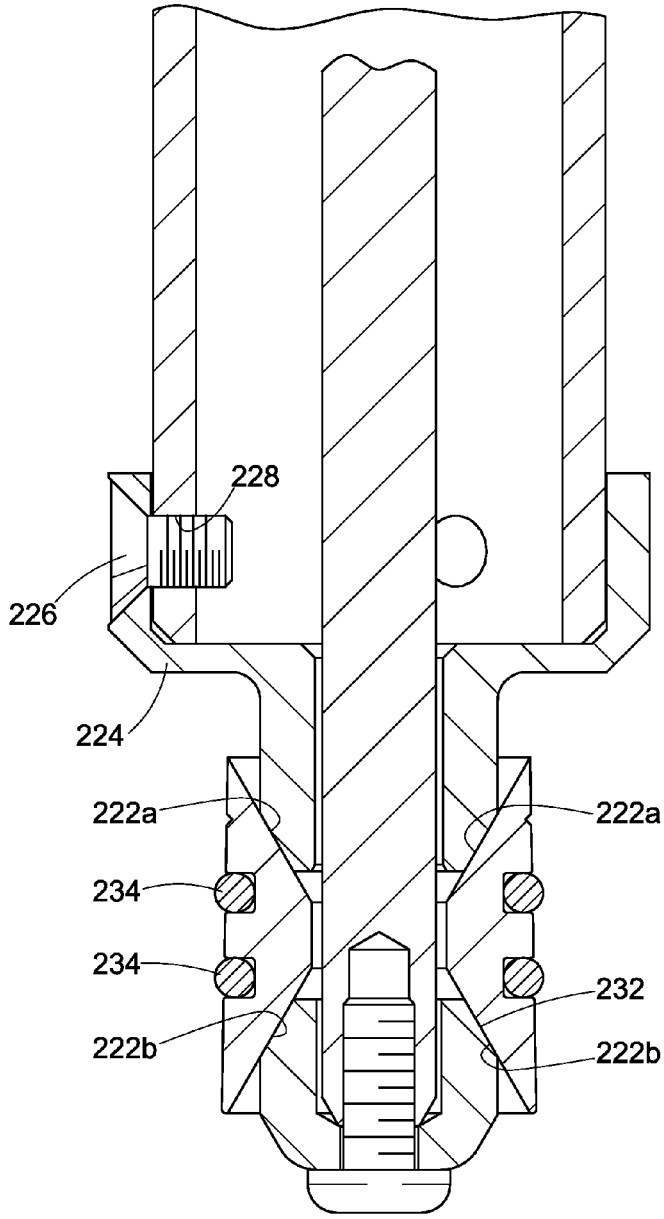
FIG. 16 is an enlarged view of the circled area A in FIG. 15.

With reference to FIGS. 13-18 we illustrate another embodiment of a support member 200 that may be used to grip or hold a work piece. The embodiment of FIGS. 13-18 may be used to support or hold the work piece in an upright orientation, an inverted orientation or both as the case may be. The principal difference between the embodiments of FIG. 6 and FIG. 13 is the design of the collet device or work piece holder, as will be further described hereinbelow.

The support member 200 may include a voltage pick-up ring 202 comprising charge transfer material, wherein the pick-up ring 202 will contact a charge transfer member. The pick-up ring 202 is supported on an outer tube 204. An actuator rod assembly 206 in this example includes a two piece actuator rod, including a non-conductive drive section 208 and an electrically semiconductive puller section 210. The puller section 210 extends through the outer tube 204 through a collar or collet assembly 212, and has an expander 214 attached at its distal end by any suitable device such as a screw 216. The collet assembly 212 in this example comprises four similar collet segments 218*a-d* that when held together form a cylindrical or may also be a conical outer surface 220 (see FIGS. 17 and 18 also). In the case of a conical profile, the collet segments 218 may provide a reverse taper angle θ as described hereinabove. Each collet segment 218*a-d* may include first and second tapered surfaces 222 and 224. The collet assembly 212 may further include a collet holder base 224 attached to a distal end of the outer tube 204 by any suitable means such as screws 226 that cooperate with holes 228 in the outer tube, for example. The distal end of the collet holder base may include a tapered surface 230 that engages the first tapered surfaces 222 of the collet segments 218. The expander 214 may include a tapered surface 232 that engages the second tapered surfaces 222*b* of the collet segments 218. One or more resilient holders 234, for example o-rings, may be use to hold the collet segments in compression against and between the collet holder base tapered surface 230 and the expander tapered surface 232.

Figure 18:
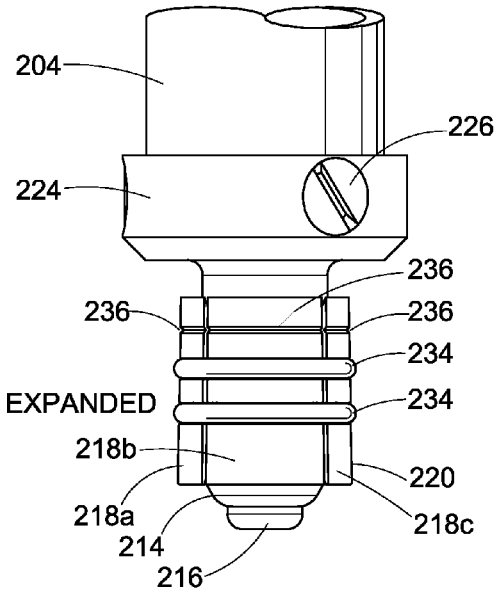

As with the embodiment of FIG. 6, when the actuator rod 206 is in a first or axially extended position, the collet segments 218 are generally compressed together by the resilient holders 234 to a first diameter or outer dimension that would be small enough to not grip or hold a work piece. This is the position illustrated in FIG. 15 and FIG. 17. When the actuator rod 206 is axially moved to a second or retracted position, the expander 216 is pulled into the collet assembly 212 so as to force the collet holder segments apart to an expanded position such as illustrated in FIG. 18 to increase the diameter or outer dimension that may be used to have the collet segments 218 engage an interior surface of a work piece. In addition to the axial movement of the actuator rod 206, the drive mechanism D may impart rotational movement as well so as to rotate the work piece during a coating operation. Again, different sized work pieces may be accommodated by the overall outer dimension of the collet segments 218 up to the maximum dimension that is forced by retraction of the expander 216. Even more sizes may be easily accommodated by simple change-out of the collet segments 218 by removing the resilient holders 234 and using a different size set of collet segments 218, which may also include a different size replacement for the expander 216 and the collet holder base 224. The collet segments 218 may include one or more indicia 236 such as grooves or bands to indicate proper installation orientation.

The two piece actuator rod 208 may be threaded together end to end, for example, as shown or connected by other suitable means. The two piece rod 208 permits the electrical energy to be applied only to the collet assembly 212 and not back to the actuator rod drive mechanism D, with again the electrostatic charge being substantially contained within the outer tube 204 and any attached work piece.

The voltage pick-up ring 202 may make electrical connection with the charge transfer material of the actuator rod puller section 210 using spring biased pins 238. Preferably but not necessarily, the expander 214 may be made of the charge transfer material as well as the collet segments 218 that will be in intimate contact with an interior surface of the work piece during a coating operation. The resilient holders 234 may also but need not comprise the charge transfer material.

Figure 19:
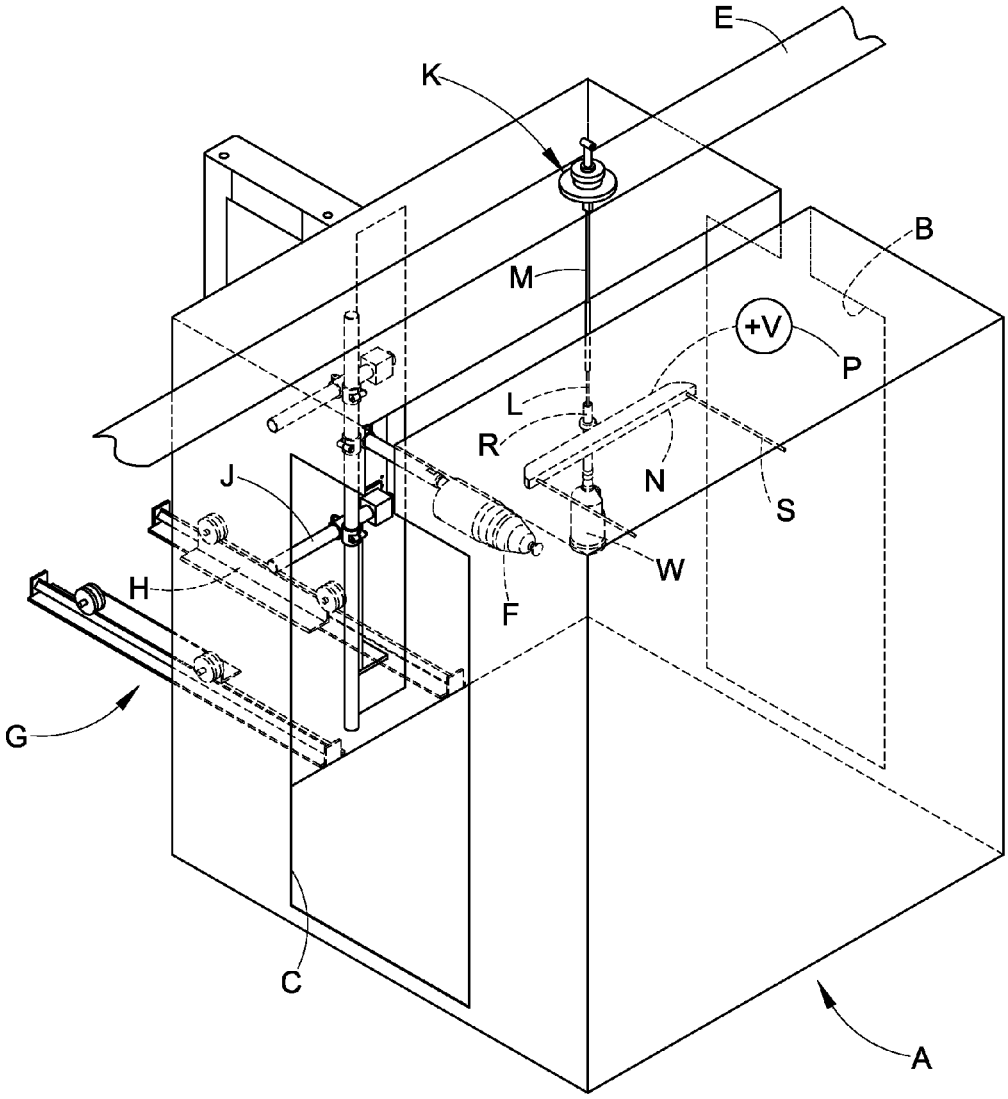
FIG. 19 is a simplified perspective of an electrostatic spray booth with an arrangement for using a support member with upright orientation of the work pieces.

With reference to FIG. 19, as noted above, the support members of FIGS. 6 and 13, for example, may be used for holding or gripping work pieces W such as bottles in an upright orientation for a coating operation. In a typical but exemplary arrangement, the spray booth A may include in and out openings B, C through which work pieces are transported via an overhead conveyor E past the electrostatic spray coating device F. The spray device or devices may be mounted on a movement system G such as an oscillator H that moves the spray devices up and down during a coating operation and a gun mover J that moves the spray devices in and out of the booth A as needed. The work pieces W may hang from the overhead conveyor from an actuator motor K that may impart rotation to the support member L as needed during a coating operation and linear movement of the actuator rod M at appropriate times to grip and release the work pieces as needed. A charge transfer member N which may comprise a semiconductive or non-metallic charge transfer material is electrically coupled to an electrical energy source P. As the conveyor transports the work piece past the spray device F, the charge transfer member N is in contact with the pick-up ring R of the support member L so that offsetting electrostatic charge may be applied to the work piece W as described hereinabove. As in the embodiment of FIG. 1, the work pieces may hang from the conveyor so as to engage the charge transfer member N in a slightly off-axis position so that the weight of the container or work piece holds the pick-up ring R in contact with the charge transfer member N.

Optionally, the charge transfer member N may be supported by a non-conductive frame S such that there is a non-conductive zone surrounding the work piece, for example a zone wherein there is no conductive member or grounded material within a desired distance of the work piece. A typical distance might be, for example, eighteen inches. This non-conductive zone also allows for the containers to bleed off the residual charge to atmosphere after the support member 32 leaves contact with the charge transfer member 44. The non-conductive zone is facilitated by the use of the non-conductive outer tube (34, 84, 204) by which offsetting electrostatic charge and voltage may be generally confined to within the outer tube of the support member L and the work piece itself. The use of the semiconductive and preferably non-metallic material for charge transfer from the electrical energy source to the work pieces also may be used as part of a low capacitance spray coating system because the support member and the charge transfer member may be made of low capacitance materials for the current carrying portions, and non-conductive materials for the other components, including if so desired the mechanism by which the work pieces are suspended from an overhead conveyor and rotated during a spray coating operation. While the embodiment of FIG. 5 may use a conductor 58, such is not required and instead the charge transfer material may be used. The conductor 58 in any event is short and is connected between two pieces of charge transfer material so that the capacitance of the support member 32, if any, would be very low and current limited.

The inventive aspects have been described with reference to the exemplary embodiments. Modification and alterations will occur to others upon a reading and understanding of this specification. It is intended to include all such modifications and alterations insofar as they come within the scope of the appended claims or the equivalents thereof.

We claim:

1. Method for electrostatically coating a container, comprising the steps of:

applying coating material to the container from an electrostatic coating device having a first electrical polarity, supporting the container while the coating is applied and before and after the coating is applied, providing direct contact between a portion of the container and a non-metallic charge transfer material while the container is supported, applying an offsetting electrostatic charge to the container before, during and/or after the time that the coating material is being applied to the container by using electrical energy applied to said non-metallic charge transfer material from an electrical energy source, said electrical energy having a second electrical polarity that is opposite to said first electrical polarity, adjusting a voltage from said electrical energy source to control said offsetting electrostatic charge applied to the container.

2. The method of claim 1 comprising the step of monitoring current from the electrical energy source to adjust said voltage.

3. The method of claim 1 comprising the step of conveying the container past the electrostatic coating device and supporting the container on a spindle that rotates.

4. The method of claim 1 comprising the step of applying said voltage to a stationary charge transfer member and providing contact between said charge transfer member and a portion of said non-metallic charge transfer material while the container is conveyed past the electrostatic coating device.

* * * * *